United States Patent [19]

Caudill

[11] Patent Number: 4,719,129

[45] Date of Patent: Jan. 12, 1988

[54] MULTIPLE NOZZLE JET FINISHING

[75] Inventor: Forrester Caudill, Middletown, Ohio

[73] Assignee: Armco Inc., Middletown, Ohio

[21] Appl. No.: 12,581

[22] Filed: Feb. 9, 1987

[51] Int. Cl.[4] ..... B05D 1/40; B05D 1/42; B05D 1/18

[52] U.S. Cl. ..... 427/348; 427/349; 427/434.2; 118/63

[58] Field of Search ..... 118/63; 427/348, 349, 427/434.2

[56] References Cited

U.S. PATENT DOCUMENTS

| | | | |
|---|---|---|---|
| 2,332,978 | 10/1943 | Ahern | 118/63 |
| 2,766,720 | 10/1956 | Muller et al. | 427/348 |
| 2,981,223 | 4/1961 | Olszowka | 118/63 |
| 3,459,587 | 8/1969 | Hunter et al. | 117/102 |
| 4,137,347 | 1/1979 | Graff et al. | 427/349 |
| 4,330,574 | 5/1982 | Pierson et al. | 427/349 |
| 4,417,540 | 11/1983 | Wohlfeil | 118/63 |
| 4,446,812 | 5/1984 | Wang | 118/63 |
| 4,557,952 | 12/1985 | Mitch et al. | 427/432 |

FOREIGN PATENT DOCUMENTS

| | | | |
|---|---|---|---|
| 2114315 | 9/1972 | Fed. Rep. of Germany | 118/63 |
| 60-82652 | 5/1985 | Japan . | |
| 784657 | 10/1957 | United Kingdom | 118/56 |

*Primary Examiner*—Shrive P. Beck

*Attorney, Agent, or Firm*—R. J. Bunyard; R. H. Johnson; L. A. Fillnow

[57] ABSTRACT

Apparatus and method for controlling and leaving different thickness coatings on a continuous web. A jet finishing assembly includes a support means and at least two rotatably mounted jet finishing knives. The orifice opening of each knife is a different height corresponding to a different thickness coating to be left on the web. When the coating thickness requirement for the web changes, the finishing knives are rotated until a knife having the appropriate orifice opening for leaving the required coating thickness is adjacent the passing web.

14 Claims, 8 Drawing Figures

MULTIPLE NOZZLE JET FINISHING

BACKGROUND OF THE INVENTION

This invention relates to jet finishing of a continuous web passing through a coating pot to control the thickness of the coating and to be able to leave coatings of different thicknesses. More particularly, the invention relates to an assembly having rotatably mounted jet knives having different orifice openings for providing different coating thicknesses.

It is well known to use jet finishing knives for controlling the thickness of liquid coatings in hot dip metal coating processes for metals such as zinc and aluminum and in the coated paper and film industries. The liquid coating remaining on the metal strip, film or paper web, all three herein being referred to as webs, must be uniformly controlled across the width and along the length of the web to obtain a satisfactory product. The major problem when scheduling production on a coating line, particularly in the steel industry, is to schedule extended production runs for material to receive the same class of coating weights, i.e. same thickness. This means much material must remain in inventory for extended periods of time because the coating ordered does not match that of the current production schedule. This not only increases costs for the manufacturer, but also increases costs for the customer because both must maintain larger inventories. Furthermore, an extended line stoppage is required to change nozzle size when scheduling a different class of coating weight.

A different but related problem occurs when producing two side differential coatings. A differentially coated galvanized steel strip typically has a thin alloyed zinc coating on one side of the strip and a thick unalloyed zinc coating on the other side of the strip. Switching a production schedule for producing two side coatings of the same thickness to a production schedule for producing differential coatings normally requires a line stoppage to change the nozzle size of at least one of the jet finishing knives.

It previously has been proposed that multiple coating weights can be obtained using a pair of opposed jet knives for two side hot dip coating. U.S. Pat. No. 3,459,587 issued to D. L. Hunter, et al. discloses higher strip speeds, reduced gas pressures in the jet knives and a greater distance between the jet knives and the strip can produce heavier coating weights. Conversely, lower strip speed, higher gas pressure in the jet knives and a shorter distance between the strip and the jet knives can produce lighter coating weights. This patent further discloses that for given strip speed, gas pressure and distance between the strip and jet knives, coating weight can be varied using different orifice heights in the nozzles of the jet knives. Increased orifice height decreases coating weight due to the increase of gas passing through the larger orifice opening.

Varying one or more of the above parameters to produce different coating weights has not been very successful. Line speeds generally cannot be varied since they are limited by the heating capability of the furnace in the coating line. It is difficult to maintain good coating quality if the distance between the strip and nozzle is not maintained at the preferred distance determined for a given coating line. It is difficult to be able to vary and then accurately maintain constant gas pressure passing through the jet knives to produce different coating weights. Temperature changes to the gas, thermal expansion of the nozzle orifice, coating metal splatter into the orifice, etc. may cause the gas pressure to fluctuate from time to time. Finally, it is not practical to produce different coating weights by changing gas pressure while maintaining a constant orifice height. Producing light coatings using a large orifice opening may be limited by insufficient supply of the jet finishing gas. Using a small orifice opening for producing heavier coatings may result in poor surface appearance i.e. "jet lines".

It previously has been proposed to use multiple jet knives mounted for rotation so that either one of the knives could be used for controlling the weight of the liquid coating. The knives are identical, the extra one serving as a replacement if the main knife becomes damaged or plugged from coating splatter.

Unlike the prior art, my invention utilizes knives having different sized orifices or nozzle openings so that by rotating a different knife into position, a different coating thickness can be placed onto the web. This arrangement solves the production scheduling and inventory problems referred to above. It permits a production schedule to include a variety of coating weights or differential coatings without any need for shutting down the coating lines to apply a different coating weight to the web. Furthermore, each coating weight can be accurately maintained because those parameters affecting coating weight do not have to be changed. To change coating weight, the operator observes the tail end of a web receiving a first coating weight as it passes through the coating pot. He then rotates the jet knives until a nozzle having the appropriate orifice height is adjacent the passing web for the next lot of material requiring a second coating weight.

BRIEF SUMMARY OF THE INVENTION

This invention relates to an apparatus and method for controlling and providing different coating thicknesses on at least one side of a continuous web. The web passes through a coating pot and adjacent to an assembly including a support means and rotatably mounted jet knives for discharging pressurized gas against the web to remove excess liquid coating. Each knife includes a nozzle for discharging the gas with one of the nozzles having a first orifice height for leaving a coating of a desired thickness and another of the nozzles having a different orifice height for leaving a coating of a different desired thickness. The assembly includes a valve for permitting gas flow through only the knife adjacent the web for removing excess liquid coating.

When it is desirable to coat both sides of the web, a pair of opposing assemblies on opposite sides of the web may be used. If it is desirable to protect the liquid coating from air, a sealed enclosure may be placed around the jet knives and at least the exit portion of the coating pot.

It is a principal object of this invention to provide jet knives which permit an operator to control liquid coating on a web to a first desired thickness and rapidly change to a second desired thickness without interrupting the movement of the web on the coating line.

An advantage of this invention is the reduction of manufacturing costs. Inventories may be reduced because material to be coated requiring different classes of coating weights may be scheduled together. Furthermore, coating line stoppages to install a knife having a different orifice opening can be eliminated.

The above and other objects, features and advantages of my invention will become apparent upon consideration of the detailed description and appended drawing.

DETAILED DESCRIPTION OF THE PREFERRED EMBODIMENT

Figure 1:
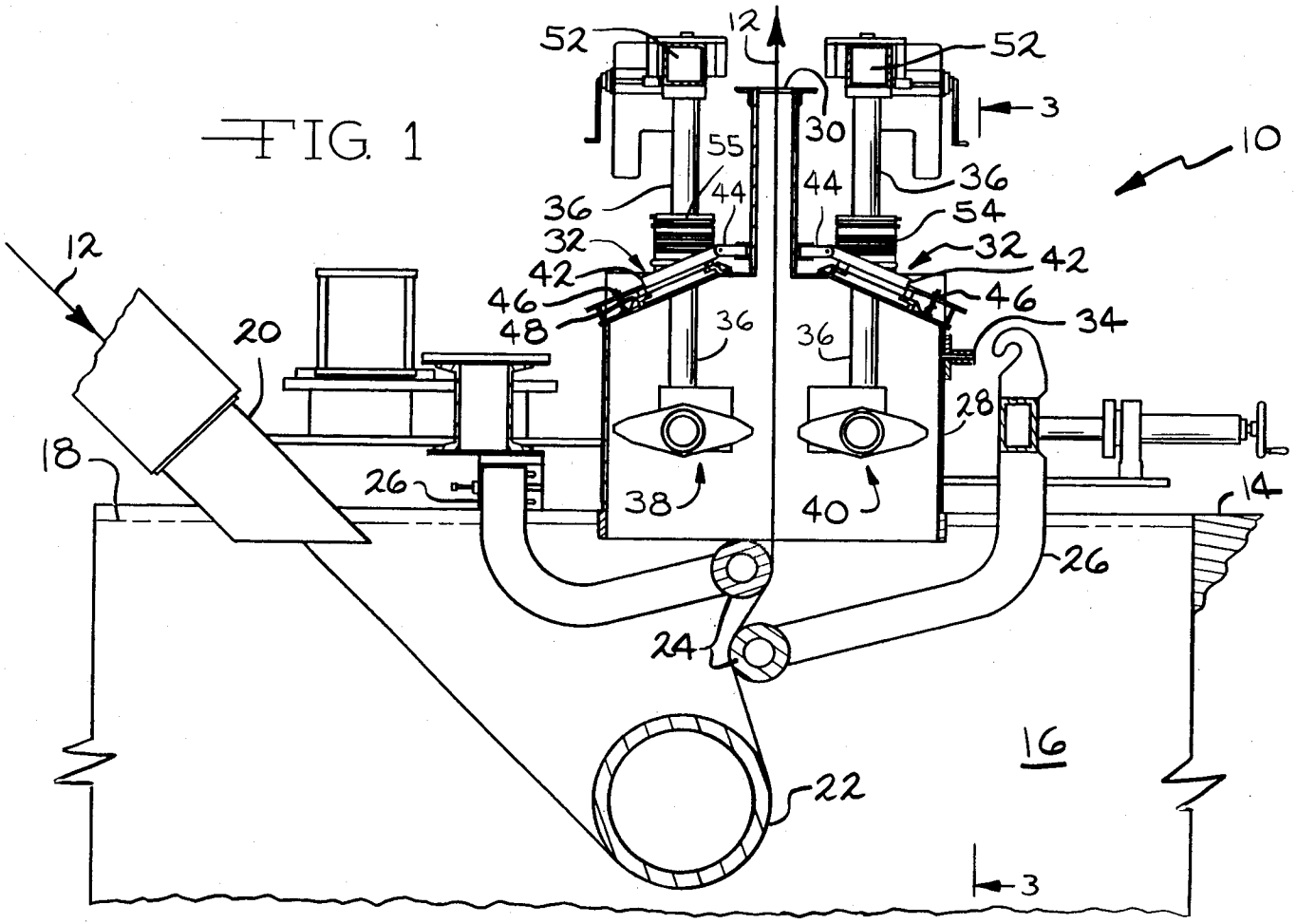
FIG. 1 is a sectional view showing a web passing through a coating pot and having excess liquid coating removed.

Referring to FIG. 1, the reference numeral 10 denotes an apparatus for two-side dip coating incorporating one embodiment of the invention. A web 12 moves along a feedpath by passing into a coating pot 14 containing a molten coating bath 16. For hot dip metal coating, the web normally is given a surface preparation and heat treatment and maintained in a protective atmosphere contained in an entry snout 20 submerged below a metal level 18. Web 12 continues along the feedpath by passing around a sink roller 22 and then passes vertically between stabilizing rollers 24 supported by arms 26. Web 12 exits coating bath 16, enters a sealed enclosure 28 and passes between a pair of opposed jet finishing assemblies 38, 40, finally exiting through a chimney 30. Enclosure 28 includes a pair of access ports 32 which normally are closed by covers 42, connected by hinges 44, fasteners 46, and sealed by seals 48, 50. A finishing gas, such as nitrogen, is supplied to plenums 52 and flows into finishing assemblies 38, 40 through pipes 36 which are sealed with enclosure 28 by rubber bellows 54, 55.

Figure 2:
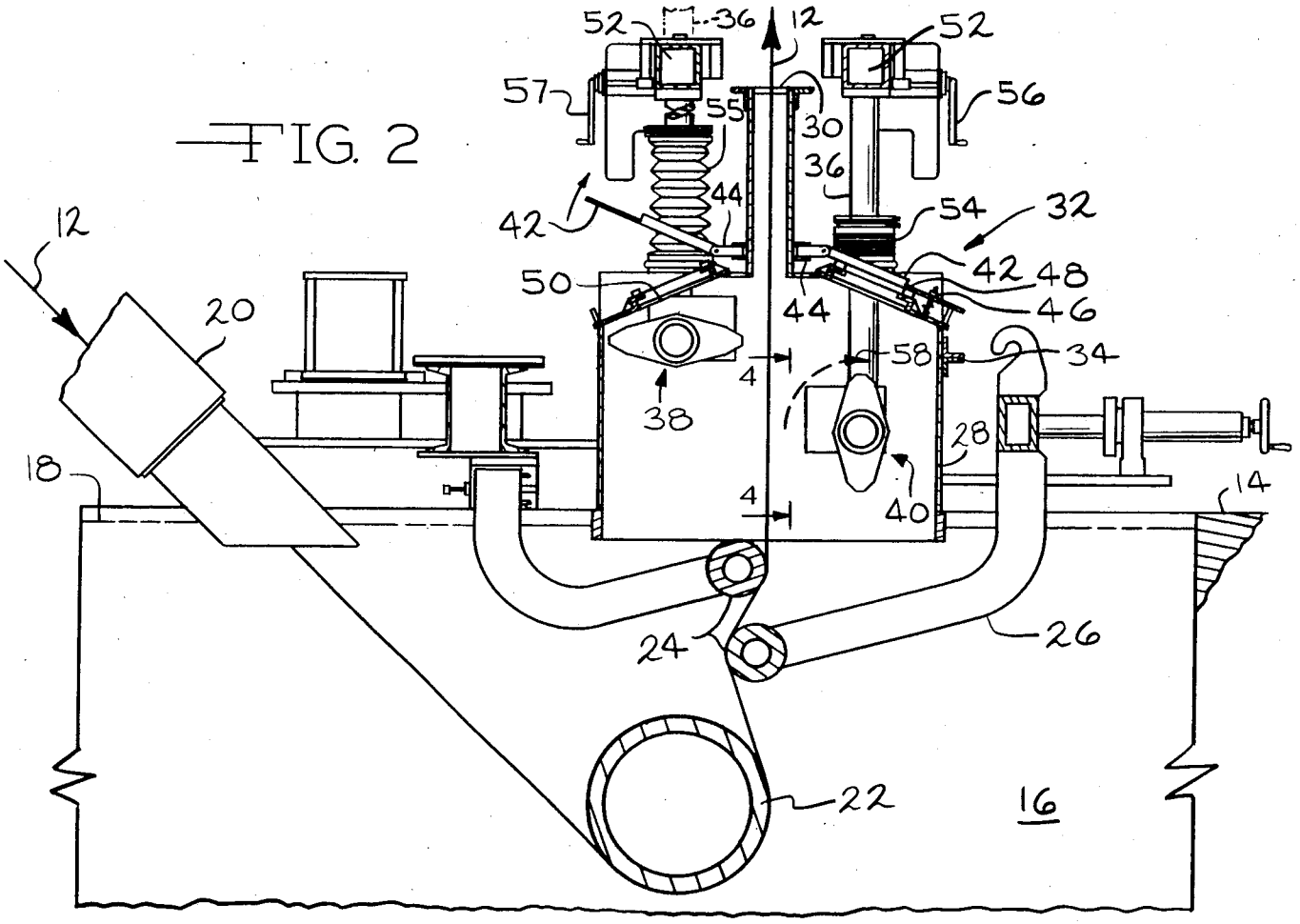
FIG. 2 is a sectional view similar to FIG. 1 showing maintenance and rotation of the jet knives.

The purpose of access ports 32 is to allow an operator access to the inside of enclosure 28 for maintenance or replacement of finishing assemblies 38 or 40. As illustrated in FIG. 2, bellows 55 is expanded as assembly 38 is raised by hand crank 57. Cover 42 is raised and assembly 38 may be repaired or replaced if necessary. Of course, assembly 40 could similarly be raised by crank 56 and be repaired or replaced through another cover 42.

As will be discussed in detail later, each jet finishing assembly includes a support means and at least two rotatably mounted knives. FIG. 2 illustrates the knives being rotated (arrow 58) wherein one knife providing a first coating thickness on one side of web 12 is being taken out of service and a second knife is about to be put into service to provide a coating having a second thickness. Of course, the knives for assembly 38 can be similarly rotated.

FIGS. 1 and 2 illustrate the use of the invention for two side hot dip metal coating of steel strip using a protective atmosphere. It will be understood by those skilled in the art the invention could be used for one side coating. For one side coating, only one jet finishing assembly may be required. For hot dip metal coating or coating using other coating liquids, the use of a protective atmosphere may not be necessary. In that event, the use of sealed enclosure 28 would not be necessary. Other gases such as air or gases contaminated with air cold be used to remove the excess liquid coating. Nevertheless, the present invention has primary utility for hot dip metal coating for steel strip with coating metals such as zinc, aluminum or alloys thereof. By using an inert finishing gas and maintaining an atmosphere in the enclosure having less than 1000 ppm oxygen, preferably less than 300 ppm oxygen, and especially less than 100 ppm oxygen, my invention will uniformly control coating thickness across the width and along the length of steel strip that is free of oxides and surface defects. For nonoxidizing coating using zinc or zinc alloys, zinc vapors escaping into the work environment through chimney 30 are undesirable. Zinc vapor formation will be prevented by introducing a small amount of water vapor into enclosure 28 such as through a gas inlet 34. Details of one and two side coating with hot dip metals using water vapors are provided in U.S. Pat. No. 4,557,952 - Mitch et al. which is incorporated herein by reference.

Figure 3:
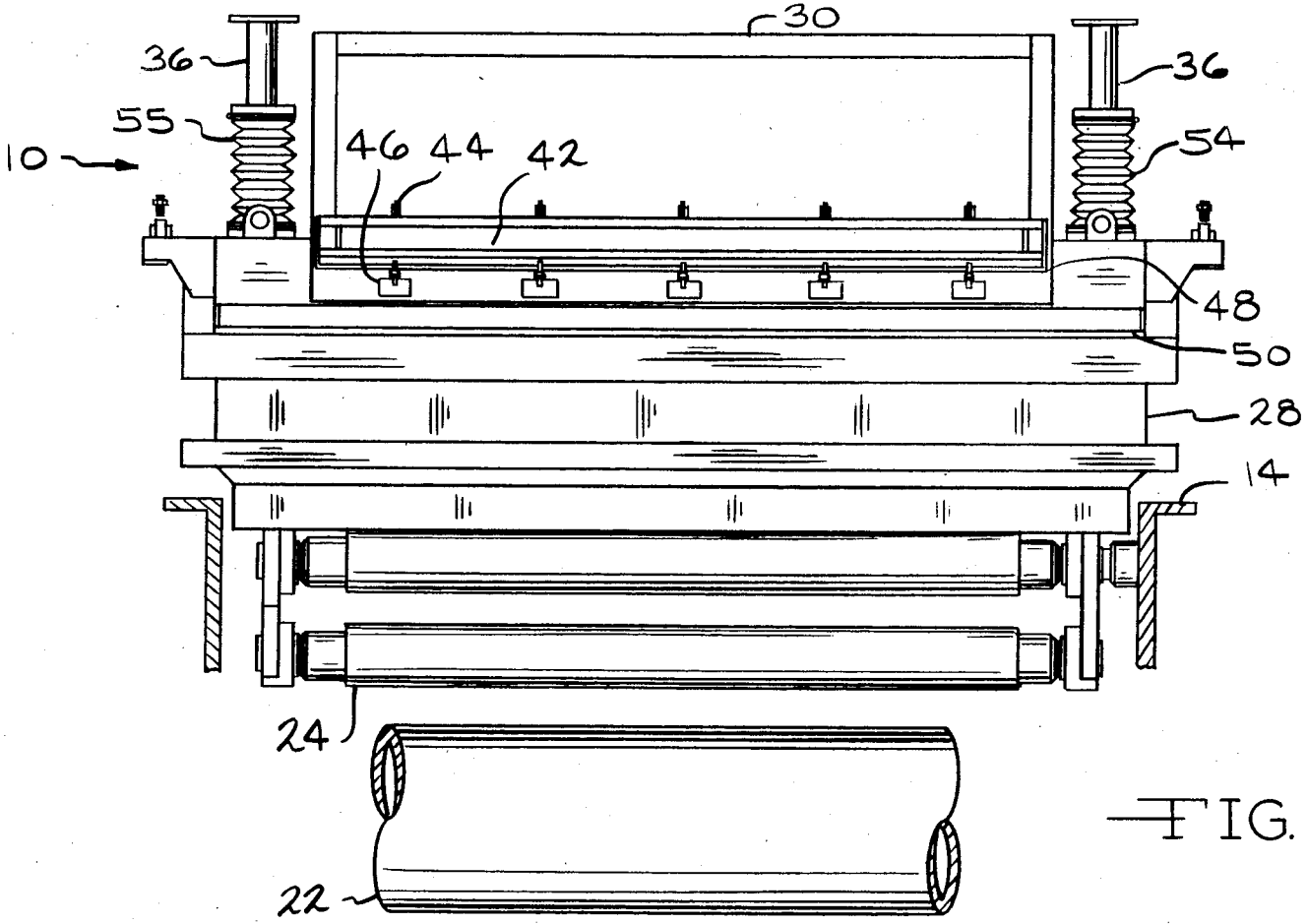
FIG. 3 is a partial elevational view along line 3—3 in FIG. 1.

FIG. 3 illustrates an elevational view of apparatus 10 taken along line 3—3 in FIG. 1. A pair of gas supply means for furnishing gas to each assembly such as pipes 36 and bellows 54, 55 are positioned on opposite sides of chimney 30. For nonoxidizing coating, sufficient inert gas passes through the gas supply means and the jet finishing assemblies to maintain a positive pressure at exit 30 to prevent entry of air. The atmosphere within enclosure 28 is further protected by seals 48 and 50 around covers 42.

Figure 4:
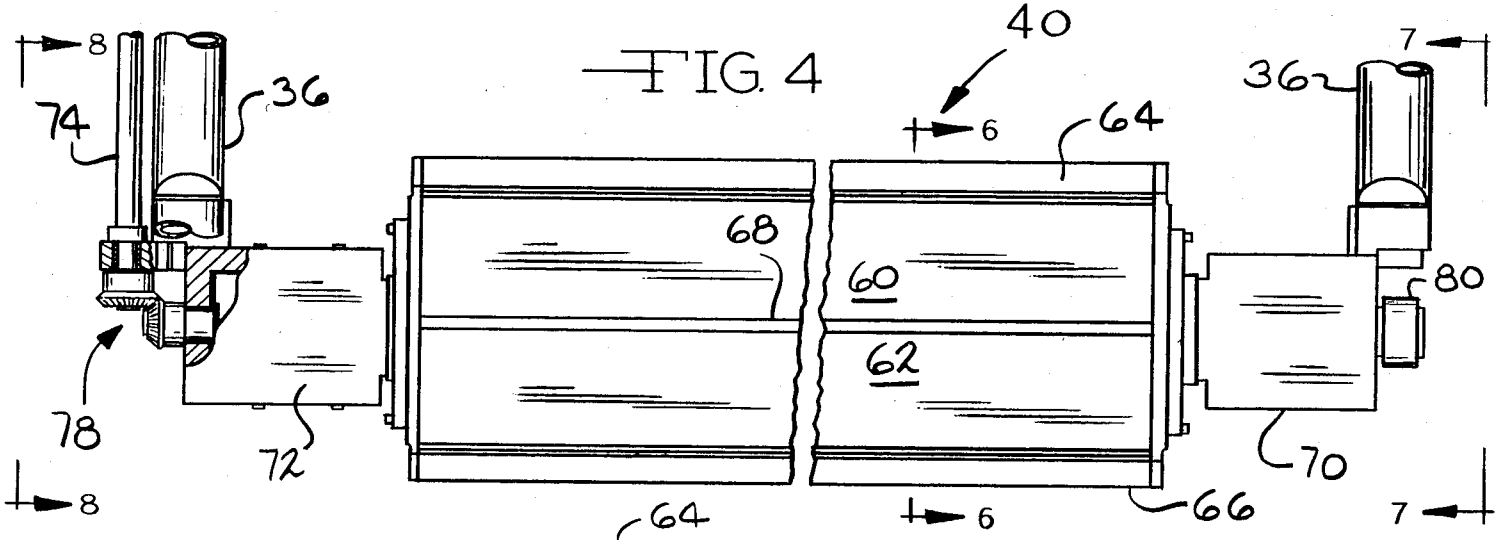
FIG. 4 is an enlarged elevational view along line 4—4 in FIG. 2 showing a jet finishing assembly.

Turning now to FIGS. 4–8, details of my novel finishing assembly will be explained. Since finishing assemblies 38 and 40 shown in FIGS. 1 and 2 are identical, a detailed explanation of only one will be given. FIG. 4 illustrates an elevational view of assembly 40 in FIG. 2. Assembly 40 includes oppositely facing knives 60 and 62 each having nozzles 64 and 66 respectively. The knives preferably are mounted equi-distantly from each other, e.g., two knives would be 180° apart and three knives would be 120° apart. Knives 60 and 62 are internally separated by a divider 68. Finishing gas is supplied to both ends of knives 60 and 62 through feed pipes 36 and support housings 70 and 72. Knives 60 and 62 are rotated by turning an arbor 88 by a bevel gear 78 which is operated by a shaft 74.

Figure 5:
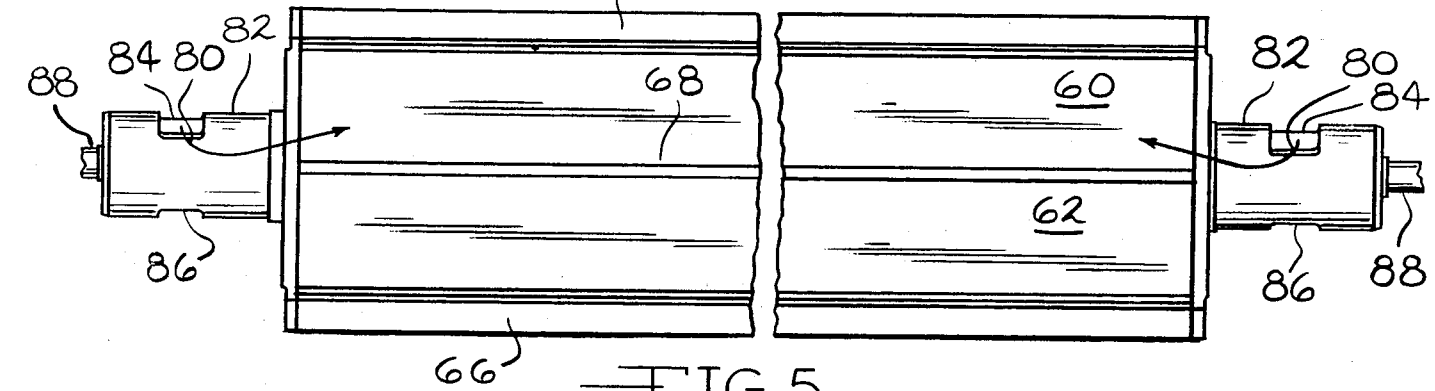
FIG. 5 is similar to FIG. 4 except the support means for the jet finishing knives have been removed.

FIG. 5 is similar to FIG. 4 except gas pipes 36, support housings 70, 72 and gear 78 have been removed. Pipes 36 and housings 70, 72 also support jet finishing knives 60 and 62. Each end of knives 60 and 62 are welded to a mandrel 82. The interior of each mandrel is divided into finishing gas passageways which communicate with the interior of each knife. For assembly 40, mandrel 82 would have two passageways with one supplying gas to knife 60 and the other for supplying gas to knife 62. Each passageway receives finishing gas from pipe 36 through openings 84 and 86. The inside cylindrical surface of support housings 70 and 72 are partially lined (not shown) with a heat resistant elastomeric material. A valve is formed by rotatably mounting mandrels 82 within support housings 70, 72 and coupling mandrels 82 to the lining so that finishing gas can pass into one of the openings, through a corresponding passageway and into the knife in use while blocking gas flow into the remaining knives. For example, FIG. 5 illustrates a finishing gas 80 flowing into opening 84, through the interior of mandrel 82, into knife 60 and discharged through nozzle 64 to remove excess coating from web 12. The valve prevents gas 80 from entering opening 86 and from flowing into knife 62. When knife 62 is to be placed into service, knives 60 and 62 would be rotated 180° by bevel gear 78. Openings 86 now occupy the positions formerly occupied by openings 84. As described above, gas 80 now passes through openings 86 and into knife 62. The valves inside mandrels 82 prevent gas 80 from entering openings 84.

Figure 6:
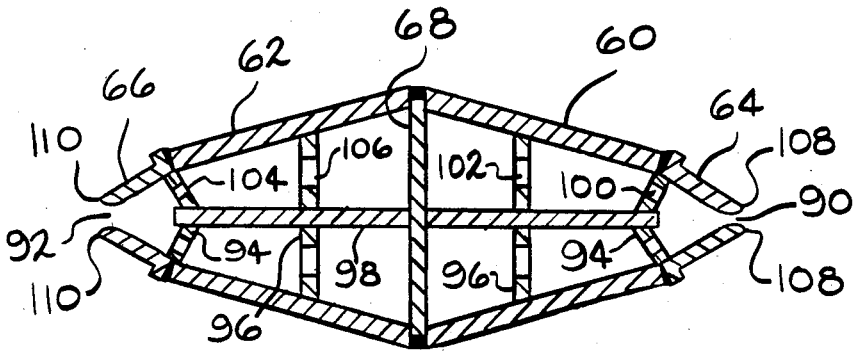
FIG. 6 is an enlarged sectional view along line 6—6 of the jet knives of FIG. 4.
Figure 7:
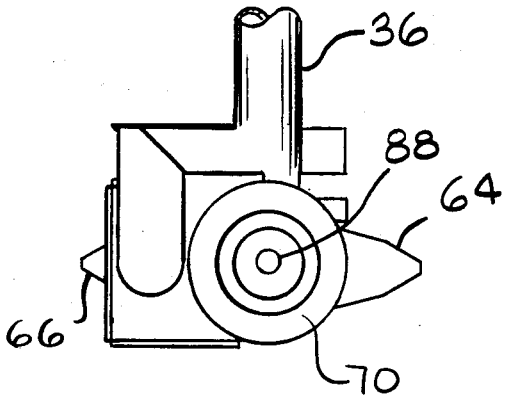
FIG. 7 is an enlarged elevational view along line 7—7 of one of the support means in FIG. 4.
Figure 8:
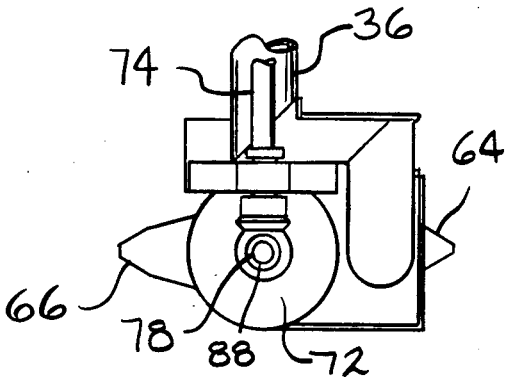
FIG. 8 is an enlarged elevational view along line 8—8 of the other support means in FIG. 4.

FIG. 6 illustrates a sectional view of knives 60 and 62 along line 6—6 in FIG. 4. Knife 60 includes nozzle 64 having a first orifice height 90 and knife 62 includes nozzle 66 having a second orifice height 92. Knives 60 and 62 are separated by divider 68. The interior of knives 60 and 62 are supported by a longitudinally extending support 98 and laterally extending supports 94 and 96. Holes 100 and 102 allow finishing gas to pass through supports 94 and 96 respectively when nozzle 64 of knife 60 is being used to control coating weight. Holes 104 and 106 allow finishing gas to pass through supports 94 and 96 respectively when nozzle 66 of knife 62 is being used to control coating weight.

As illustrated in FIG. 6, each nozzle 64 and 66 includes orifices 90 and 92, respectively. The orifice height is defined by a pair of lips 108 and 110. The orifice height will be different for each nozzle and correspond to a different thickness of coating. The pressure of the gas flowing through orifices 90 and 92 is decreased by increasing the height between lips 108 and 110 respectively thereby increasing the thickness of coating left on the web. For example, the height between lips 108 for orifice opening 90 could be 0.040 inch (1 mm) to provide a first thickness of coating and the height between lips 110 for orifice opening 92 could be 0.080 inch (2 mm) to provide a second thickness of coating.

Further explanation is now provided for using my invention. For galvanizing, typical weights of zinc coatings specified by the customer are 0.08 oz/ft$^2$ (24.6 gm/m$^2$) or 0.20 oz/ft$^2$ (61.5 gm/m$^2$) per side. Therefore, most of the coating thickness requirements can be met by using a finishing assembly having only two knives. Orifice openings providing gas flows to leave the above two coating weights would vary for each manufacturer depending on finishing gas flow rate and distance between the nozzle and web. For processing a customer order for 0.08 oz/ft$^2$ (24.6 gm/m$^2$) zinc coating, the knives positioned adjacent the steel strip would be those having a first orifice height. If a succeeding order to be processed required 0.20 oz/ft$^2$ (61.5 gm/m$^2$) coating weight, the operator could manually rotate the jet knives 180°. For example, as the tail end of the strip receiving the light weight coating is observed by the operator, he immediately rotates knives 60 and 62 on assembly 40 until nozzle 66 on knife 60 having large orifice 92 is adjacent passing web 12. Similarly, the opposing knives on assembly 38 also would be rotated. The heavy weight of coating remains on the succeeding strip. For coatings requiring a broader range of thicknesses, three or more knives can be provided on the assembly with the orifice opening of each nozzle corresponding to a different thickness of coating.

Two side differential coatings can also be produced without interrupting the flow of material through the coating line. In the above example, one of the assemblies can be rotated 180° so that nozzle 64 on knife 60 having small orifice 90 for one assembly is adjacent one side of the web and nozzle 66 on knife 62 having large orifice 92 for the other assembly is adjacent the other side of the web. Small orifice 90 will leave a thin coating on one side of the web and large orifice 92 would leave a thick coating on the other side of the web. After producing a differential two side coating on one or more coils of material, either one of the assemblies could be rotated again to begin producing two side coating wherein the coating on both sides of the strip would have the same thickness.

The ability to produce different coating weights can be expanded by using an assembly having three or more finishing knives. For one or two side coating, it is possible to produce three or more different coating weights. Of course, it now becomes possible to produce three or more different two side differential coatings. If a pair of jet finishing assemblies having three or more knives are being used to produce two-side coating on a web wherein the coating thickness on both sides of the web are the same, one or both of the assemblies can be rotated to produce various differential coatings.

While only two embodiments of my invention have been described, it will be understood various modifications may be made to it without departing from the spirit and scope of it. For example, one or two finishing assemblies may be used. Each assembly will have two or more knives with the orifice opening of each nozzle corresponding to a different thickness of coating. The actual orifice height used will depend on the liquid coating and coating weights required. The assembly may be enclosed in a sealed enclosure. Therefore, the limits of my invention should be determined from the appended claims.

I claim:

1. A method of controlling and providing different coating thicknesses on at least one side of a web as the web moves along a feedpath in a coating line, the coating line including a jet finishing assembly, the assembly including a support means, at least two rotatably mounted jet finishing knives and including a valve, the nozzle of each knife having a different orifice height, comprising the steps of:

passing said web having excess coating from a coating pot, discharging pressurized gas from one of said knives adjacent said web having a first orifice height to remove said excess coating leaving a coating of a first thickness, blocking said gas from passing through said remaining knives by said valve, rotating said knives until another of said knives having a different orifice height is adjacent said web, discharging said gas from said other knife to remove said excess coating leaving a coating of a second thickness, blocking said gas from passing through said remaining knives by said valve.

2. A method as set forth in claim 1 wherein said support means includes said valve and a gas passageway for each of said knives, passing said gas through the passageway to said knife adjacent said web.

3. A method as set forth in claim 1 wherein said web is passed between a pair of said assemblies.

4. A method as set forth in claim 3 for producing a two side coating including the step of rotating said knives of at least one of said assemblies so that the two knives adjacent said web have the same orifice height whereby the coating thickness on each side of said web is substantially the same.

5. A method as set forth in claim 3 for producing a two side differential coating including the step of rotating said knives of at least one of said assemblies so that the two knives adjacent said web have different orifice heights whereby the coating thickness on one side of said web is substantially different than the coating thickness on the other side of said web.

6. A method as set forth in claim 5 for producing a two side differential coating including the step of rotating said knives of both of said assemblies.

7. A method as set forth in claim 5 for producing a two side coating including the step of rotating said knives of at least one of said assemblies so that the two knives adjacent said web have the same orifice height whereby the coating thickness on each side of said web is substantially the same.

8. A method as set forth in claim 4 for producing a two side differential coating including the step of rotating the knives of at least one of said assemblies so that the two knives adjacent said web have different orifice heights whereby the coating thickness on one side of said web is substantially different than the coating thickness on the other side of said web.

9. A method as set forth in claim 8 for producing a two side coating including the step of rotating said knives of at least one of said assemblies so that the two knives adjacent said web have the same orifice height whereby the coating thickness on each side of said web is substantially the same.

10. A method as set forth in claim 8 for producing a two side differential coating including the step of rotating said knives of both of said assemblies.

11. A method as set forth in claim 1 including surrounding said assembly and a portion of said coating pot with a sealed enclosure, passing an inert gas through said knife adjacent said web, maintaining the atmosphere within said enclosure to less than 1000 ppm oxygen.

12. A method as set forth in claim 11 including maintaining said atmosphere within said enclosure to less than 300 ppm oxygen.

13. The method as set forth in claim 11 wherein said enclosure includes a sealed access means, displacing said assembly vertically upward and maintaining, replacing and the like said assembly through said access means.

14. A method of controlling and providing different coating thicknesses on at least one side of a web as the web moves along a feed path in a coating line, the coating line including a jet finishing assembly, the assembly including at least two rotatably mounted jet finishing knives positioned between two support means, the nozzle of each knife having a different orifice height, each support means including a gas passageway for each knife and a valve, comprising the steps of:

passing said web having excess coating from a coating pot, passing pressurized gas through the passageway and discharging said gas from one of said knives adjacent said web having a first orifice height to remove said excess coating leaving a coating of a first thickness, blocking said gas from passing through the passageways for the remaining of said knives, rotating said knives until another of said knives having a different orifice height is adjacent said web, passing said gas through the passageway for said other knife and discharging said gas from said other knife to remove said excess coating leaving a coating of a second thickness, blocking said gas from passing through the passageways for the remaining of said knives.

* * * * *